United States Patent [19]

Takei et al.

[11] 4,302,521

[45] Nov. 24, 1981

[54] PHOTOSENSITIVE ELEMENT FOR ELECTROPHOTOGRAPHY

[75] Inventors: Yoshiaki Takei; Yoneko Kimura; Hiroyuki Nomori, all of Hachioji, Japan

[73] Assignee: Konishiroku Photo Industry Co., Ltd., Tokyo, Japan

[21] Appl. No.: 169,173

[22] Filed: Jul. 15, 1980

[30] Foreign Application Priority Data

Jul. 16, 1979 [JP] Japan ..... 54-89283

[51] Int. Cl.[3] ..... G03G 5/09; G03G 5/14

[52] U.S. Cl. ..... 430/59; 430/58; 430/81; 430/96

[58] Field of Search ..... 430/58, 59, 81, 88, 430/96

[56] References Cited

U.S. PATENT DOCUMENTS

| | | | |
|---|---|---|---|
| 3,037,861 | 6/1962 | Hoegl et al. | 430/81 X |
| 3,287,119 | 11/1966 | Hoegl | 430/81 X |
| 3,837,851 | 9/1974 | Shattack et al. | 430/58 X |
| 3,871,884 | 3/1975 | Matsumoto et al. | 430/81 X |

*Primary Examiner*—Roland E. Martin, Jr.
*Attorney, Agent, or Firm*—Bierman & Bierman

[57] ABSTRACT

The present invention relates to a photosensitive element for electrophotography comprising on an electrically conductive support a charge carrier generating phase and a charge carrier transport phase containing a P-type organic semiconductor, a poly-N-vinylcarbazole and/or its derivative, a Lewis Acid and a Brønsted acid.

8 Claims, 5 Drawing Figures

PHOTOSENSITIVE ELEMENT FOR ELECTROPHOTOGRAPHY

The present invention relates to a photosensitive element for electrophotography, particularly to a photosensitive element comprising a carrier transport phase which may be combined with a substance which forms a carrier generating phase on absorption of light.

Generally speaking, substances which, on absorption of visible light, is capable of generating charged carrier have little film-forming ability of itself, with a few exceptions such as amorphous selenium, etc. In addition, they are rather poor in retentivity of electric charges imparted on its surface, and therefore it is almost impossible for them to form a photosensitive layer of a photosensitive element for electrophotography. On the contrary, those substances that have an excellent film-forming property as well as electrical characteristics required as a photosensitive layer e.g., such substance in its film-form of about 10μ thickness as is capable of retaining electric charges of 500 V or higher for a long period of time, tend to have less sufficient photoconductivity on absorption of visible light, and therefore it is also impossible to form a photosensitive layer with such a substance alone.

There have been recently proposed to make a photosensitive layer by using a carrier-generating phase containing a substance capable of generating charged carrier on absorption of visible light and a carrier-transport which serves to transport either one of both of positive and negative charged carriers produced in the said carrier generating phase in combination.

Thus, the use of different types of substances or group of substances which bear two functions in a photosensitive layer, i.e., the generation and transportation of charged carriers, permits choice of such substance applicable to construct a photosensitive layer from a wide variety of the substances and, in addition, this permits independent choice of such substances or group of substances which are capable of fulfilling various required properties, and this make it possible to construct a photosensitive layer having various advantageous characteristics, e.g., high surface potential when charged, high charge retentivity, high serface strength, high photosensitivity and sufficient stability against repeated use.

As for such photosensitive layer, the following are so far known, for example;

(1) A photosensitive layer comprising a carrier generating layer containing amorphous selenium or cadmium sulfide as a carrier generating phase and a carrier transport layer containing poly-N-vinylcarbazole as a carrier transport phase.

(2) A photosensitive layer comprising a carrier generating layer containing amorphous selenium or cadmium sulfide as a carrier generating phase and a carrier transport layer containing as a carrier transport phase 2,4,7-trinitro-9-fluorenone.

3. A photosensitive layer comprising a carrier generating layer containing as a carrier generating phase perylene derivative and a carrier transport layer containing as a carrier transport phase oxydiazole derivative (such as disclosed in U.S. Pat. No. 3,871,882).

(4) A photosensitive layer comprising a carrier generating layer containing as a carrier generating phase chlorodiane blue or methyl squarylium and a carrier transport layer containing as a carrier transport phase a pyrazoline derivative (such as disclosed in Japanese Patent Publication Open to Public Inspection No. 90827/1976).

As described above, although a number of photosensitive layers of this kind are so far known these known photosensitive elements have such disadvantageous properties that its working life is rather short when used repeatedly in an electrophotographic process, due to the remarkable electric fatigue of the photosensitive layer. That is to say, it is essential for electric charge on a photosensitive layer to be neutralized when the said photosensitive layer, after completion of one electrophotographic process, is to be used repeatedly for the next electrophotographic process, however, because of a very slow electric discharging velocity at the last stage of said discharging process of such photosensitive layer, and remaining of a considerably high residual potential on its surface and, in addition, because of accumulative increase of residual electric potential due to repeating of electrophotographic processes, which results in exceeding of the residual potential over upper limit by a small number of successive copying, such repeated use often becomes impossible even when such neutralization is carried out with a large amount of exposure.

By the use of a certain type of photosensitive elements, it may be possible to recover the surface potential into the state for further repeated use, however, it is often the case that in order to the possible restoration the photosensitive element is required to be kept out of service for a considerably long period of time, or it has to be treated by heat. Nevertheless despite of such symptomatic treatment it is almost impossible in many cases to restore said residual potential in sufficiently low level.

Furthermore, in the photosensitive elements of this type which are hithertofore known, the deterioration of its photosensitive layer caused by light, particularly ultra violet light, is serious and also the mechanical strength of said layer is relatively small. Therefore their durability to copy tends to be lowered.

The object of the present invention is to provide a novel photosensitive element for electrophotography in which such disadvantages mentioned above all eliminated, which shows less electric deterioration caused by electrophotographic process and thus has remarkably long life, particularly against long repeated use, and is provided with a photosensitive layer of which residual electric potential can be kept extremely low by neutralization, and therefore is capable of performing multiple and successive copying operations without any restoring operation, which is stable against light, particularly against ultra-violet light, and which has mechanical strength.

Thus the present invention relates to a photosensitive element for electrophotography comprising on an electrically conductive support a carrier generating phase and a carrier transport phase containing a P-type organic semiconductor, a poly-N-vinylcarbazole and/or its derivative, a Lewis acid and a Brønsted acid.

The invention is illustrated in detail with reference to the attached drawings.

According to one of the preferable embodiments of the present invention, as shown in FIG. 1, a layer containing carrier generating phase (hereinafter referred to as a carrier generating layer) 2 is provided on an electrically conductive support 1, and a layer containing a carrier transport phase (hereinafter called as carrier transport layer) 3 comprising P-type organic semiconductor, poly-N-vinylcarbazole and/or its derivative, Lewis acid, and Brønsted acid, is superposed on the said carrier generating layer 2, thus to form a photosensitive layer 4.

Hence, as for the materials of said electric conductive support 1, the following metals may be used, for example, aluminium, nickel, copper, zinc, palladium, silver, indium, tin, platinum, gold, stainless steel, brass, etc. However, they are not limited to the above examples, but for additional example as shown in FIG. 2, it may also constitute an electric conductive support 1 by arranging the conductive layer 1B on the insulating base 1A. As for the base 1A in this case, the materials having deflectability such as paper, plastic sheet, etc., and also having sufficient strength against stresses such as tensile stress, etc. are suitable. And, said electric conductive layer 1B may be arranged by laminating metal, or by evaporating in vacuum a metal to be deposited, or by applying the other methods.

The carrier generating phase to form the said carrier generating layer 2 can be formed by the use of either a carrier generating substance alone, or such substance together with a suitable binder, or such substance further in combination with a substance having a great mobility to a carrier having a specified or unspecified polarity. Any inorganic pigment and organic dye may be used as a carrier generating substance if said pigment or dye can, on absorption of visible light, generate free carries. And, by applying vacuum evaporation method or by coating said carrier generating substance dissolved or dispersed in a suitable solvent and thereafter drying it, the said carrier generating layer 2 can be formed on the surface of electric conductive support 1. In the case coating method is employed, it is preferable for the coating composition to contain binder resin and carrier transfer substance, wherein the mixing ratio of binder resin, carrier transfer substance and carrier generating substance is 100: 0-500:1-600, further preferably 100:1-200:10-300 by weight. The binder resins to be usable in this case are, for example, addition polymerization type resins such as polyethylene, polypropylene, acrylic resin, methacrylic resin, vinyl chloride resin, vinyl acetate, epoxy resin, polyurethane, phenol resin, polyester resin, alkyd resin, polycarbonate resin, etc., polyaddition polymerization type resin, polycondensation type resin, and copolymerization type resin containing two or more of the repetition units of above mentioned resins, for example, vinyl chloride-vinyl acetate copolymer, vinyl chloride-vinyl acetate-maleic anhydride copolymer. However, the binder resins to be used are not limited to the above examples, but any of the resins generally applicable for the similar purpose may be used.

As for carrier generating substances, inorganic pigments, for example, amorphous selenium, trigonal system selenium, selenium-tellurium alloy, cadmium sulfide, cadmium selenide etc. can be mentioned, however, it is preferable to use organic dyes in the invention, of which typical examples are given below:

(1) Phthalocyanine dyes such as metallic phthalocyanines and non-metallic phthalocyanines.
(2) Azo dyes such as mono-azo dyes and dis-azo dyes, etc.
(3) Perylene dyes such as peryleic anhydride and peryleic imide.
(4) Indigoid dyes such as indigo and thio-indigo, etc.
(5) Perynone dyes such as bisbenzimidazole, etc.
(6) Polycyclic quinone dyes such as anthoanthrone, dibenzpyrene quinone, pyrane throne, vioranthrone, and isovioranthrone, etc.
(7) Anthraquinone dyes.
(8)a Quinacrydone dyes.
(9) Dioxadine dyes.
(10) Cyanine dyes.

As for the substances having a great mobility to a carrier having a specific or unspecific polarity which can be added to the said carrier generating phase, i.e., carrier transfer substances, the following examples can be mentioned.

(i) Electron donor type substances generally having p-conductivity, for example, poly-N-vinylcarbazole and its derivatives, aromatic amino compounds of polyarylalkane group as shown hereinafter in the general formula [P], oxadiazole derivatives as shown in the general formula [Q], and pyrazoline derivatives as shown in the general formula [R], and,
(ii) Electron acceptor type substances generally having n-conductivity, for example, a variety of $\pi$-electron and $\sigma$-electron acceptors, etc.

The thickness of the said carrier layer 2 thus formed is preferably 0.005–20 microns, particularly 0.05–10 microns.

The carrier transport layer 3 in the present invention can be formed by such process that P-type inorganic semiconductor, poly-N-vinylcarbazole and/or its derivatives, Lewis acid and Brønsted acid are dissolved in a suitable solvent, together with a suitable binder resin, if required, and the solution thereof is coated onto the said carrier generating layer 2 and then dried it up.

As for the said P-type inorganic semiconductor, aromatic amino compounds of polyaryl alkane type as shown in the general formula [P] below, oxadiazole derivatives as shown in the general formula [Q] and pyrazoline derivatives as shown in the general formula [R] respectively can be used either singly or in combination.

(1) General formula [P]

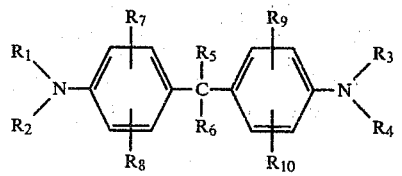

Wherein, $R_1$, $R_2$, $R_3$ and $R_4$ independently represent either one of hydrogen atom, substituted or unsubstituted alkyl group, cycloalkyl group, alkenyl group, cycloalkenyl group, or aryl group; $R_5$ and $R_6$ independently represent hydrogen atom, substituted or unsubstituted alkyl group, cycloalkyl group, alkenyl group, cycloalkenyl group, are group, or heterocyclic group; and, $R_7$, $R_8$, $R_9$ and $R_{10}$ independently represent hydrogen atom, halogen atom, acyl group, hydroxyl group, each of substituted or unsubstituted alkyl group, cycloalkyl group, a alkenyl group, cycloalkenyl group, aryl group, alkoxy group, aryloxy group or amino group; and $R_1$ and $R_2$, and/or $R_3$ and $R_4$ may jointly form cyclohydrocarbon group or heterocyclic group.

In the general formula [P], for $R_1$, $R_2$, $R_3$, $R_4$, $R_5$, $R_6$, $R_7$, $R_8$, $R_9$ and $R_{10}$ as alkyl group those having 1 to 40 carbon atoms, as alkenyl group, those having 2 to 40 carbon atoms, as cycloalkyl group and cycloalkenyl group 5-7 member rings, as alkoxy group those having 1 to 40 carbon atoms and as aryl group phenyl group, tolyl group or naphthyl group are preferable.

The heterocyclic group in case of forming nitrogen atom-containing heterocyclic group jointly by $R_1$ and $R_2$, and/or $R_3$ and $R_4$, and the heterocyclic group formed by $R_5$ and $R_6$ may be optional, but preferably they are 5-7 membered rings containing nitrogen atom, oxygen atom and/or sulfur atom, and further, they may be those in which these 5-7 membered rings are being fused with other heterocyclic group or hydrocarbon cyclic group. In addition, the said heterocyclic group may be either saturated or unsaturated.

Further, said cyclic group for forming hydrocarbon cyclic group or heterocyclic group jointly by $R_5$ and $R_6$ may be either saturated or unsaturated, being composed of with preferably 3-10 carbon.

And, in case that the each group in the general formula [P] are the substituted one, the said substituted group is, for example, halogen atom, acyl group, hydroxyl group, alkyl group (preferably, the one having 1-40 carbon atoms), cycloalkyl group, alkenyl, group, cycloalkyl group, aryl group (preferably, phenyl group, tolyl group or naphthyl group), alkoxy group (preferably, the one having 1-40 carbon atoms), aryloxy group or amino group.

(2) General formula [Q]

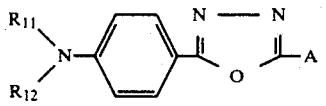

Wherein, $R_{11}$ and $R_{12}$ independently represent the same atom or group as $R_1$ and $R_2$ in the said general formula [P], and A represents substituted or unsubstituted alkyl group, amino group, aryl group or heterocyclic group. Herein, the substituent for each group may be the same one as in the general formula [P].

(3) General formula [R]

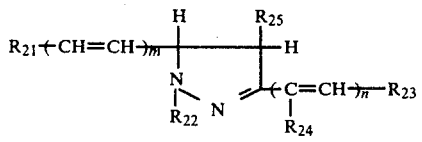

Wherein, $R_{21}$, $R_{22}$ and $R_{23}$ independently represent substituted or unsubstituted aryl group, $R_{24}$ and $R_{25}$ independently represent hydrogen atom, each of substituted or unsubstituted alkyl group or aryl group, and m and n represent 0 or 1. Herein, as for aryl group, phenyl group, tolyl group or naphthyl group is preferable, and as to alkyl group, the one having 1-40 carbon atoms is preferable. Further, the substituent for each group may be one in the general formula [P].

The chemical compounds which are represented in each of the general formulae, [P], [Q] and [R] will be described in detail.

In the present invention, poly-N-vinylcarbazole derivative which is used instead of or together with poly-N-vinylcarbazole is the one of which whole or a part of carbazole ring in the repetition unit is substituted by various substituents such as alkyl group, nitro group, amino group, hydroxy group, or halogen atom. The molecular weight of poly-N-vinylcarbazole or its derivative is arbitrary, but the one having the average molecular weight of 100,000-1,000,000 is preferable.

Lewis acid to be used in the invention means an electron acceptor based on the theory of acid-base groups defined by G. N. Lewis. Among them, however, those which function as proton donors according to the theory are excluded therefrom. The preferable Lewis acids for use in the invention are $\pi$-electron acceptors or $\sigma$-electron acceptors, and the concrete examples of which are given as 2,7-dinitrofluorenone, 2,4,7-trinitrofluorenone, 2,4,5,7-tetranitrofluorenone, tetracyanoethylene, tetracyanoquinodimethane, chloranyl, bromanyl, dichlorodicyano-p-benzoquinone, anthraquinone, dinitroanthraquinone, quinonechlorimide, p-nitrobenzonitrile, picrylchloride, o-dinitrobenzene, m-dinitrobenzene, 1,3,5-trinitrobenzene, maleic anhydride, dibromomaleic anhydride, succinic anhydride, phthalic anhydride, tetrachlorophthalic anhydride, tetrabromophthalic anhydride, 3-nitrophthalic anhydride, 4-nitrophthalic anhydride, mellitic anhydride, pyromellitic anhydride, and the other compounds having great affinity to electrons. As for the preferable ones among the above, 2,4,7-trinitrofluorenone, 2,4,5,7-tetranitrofluorenone, chloranyl, bromanyl, tetrachlorophthalic anhydride, and tetrabromophthalic anhydride can be mentioned.

Brønsted acid to be used in the invention means a proton donor based on the theory of acid-base groups defined by J. N. Brønsted. As for preferable examples of Brønsted acids for use in the invention, the following are given; trichloroacetic acid, tribromoacetic acid, $\beta$-chloropropionic acid, stearic acid, behenic acid, maleic acid, fumaric acid, crotonic acid, benzoic acid, o-nitrobenzoic acid, p-nitrobenzoic acid, 2,4-dinitrobenzoic acid, 3,5-dinitrobenzoic acid, pentafluorobenzoic acid, 2,4-dichlorobenzoic acid, salicyclic acid, 5-nitrosalicyclic acid, 3,5-dinitrosalicyclic acid, p-chloro-m-cresol, picric acid, phthalic acid, terephthalic acid, mellitic acid, DL-mandelic acid, cinnamic acid, and the other chemical compounds having carboxyl group or hydroxyl group. Among the above 3,5-dinitrobenzoic acid and picric acid are especially preferable.

As for the binder resins to form said carrier transport layer 3 comprising the above described P-type organic semiconductor, poly-N-vinyl carbazole and/or its derivative, Lewis acid, and Brønsted acid, addition copolymerized resins such as polyethylene, polypropylene, acrylic resin, methacrylic resin, vinyl chloride resin, vinyl acetate resin, epoxy resin, polyurethane, phenol resin, polyester resin, alkyd resin, polycarbonate, etc., polyaddition copolymerized resins, polycondensed resins, and copolymerized resins containing two or more out of the repitition units of the above mentioned resins can be mentioned.

As for the mixing ratio of each component of the said carrier transport layer 3, it is preferable to be within the range of 30-200 parts by weight of poly-N-vinylcarbazole or its derivative per 100 parts by weight of P-type semiconductor, and respectively 0.05-100 of Lewis acid, 0.05-100 of Bronsted acid, and 0-400 of binder resin; particularly 50-150 of poly-N-vinylcarbazole or its derivatives, 0.1-50 of Lewis acid, 0.1-50 of Bronsted acid and 10-200 of binder resin are more preferable.

Next, the typical examples of aromatic amino compounds of polyarylalkane group as shown in the general formula [P] are as follows:

(P-1) 1,1-bis(4-N,N-dimethylaminophenyl)-2-methylpropane,
(P-2) 1,1-bis(4-N,N-dimethylamino-2-methylphenyl)-cyclohexane,
(P-3) 1,1-bis(4-N,N-dimethylamino-2-methylphenyl)-1-(4-methoxyphenyl)methane,
(P-4) 1,1-bis(4-N,N-dimethylamino-2-methylphenyl)-1-(4-hydroxyphenyl)methane,
(P-5) 1,1-bis(4-N,N-dimethylamino-2-methylphenyl)-1-(2,4-dimethoxyphenyl)methane,
(P-6) 1,1-bis(4-N,N-dimethylamino-2-ethylphenyl)-1-(2,4-dimethylphenyl)methane,
(P-7) 1,1-bis(4-N,N-dimethylamino-2-methoxyphenyl)-2-methylpropane,
(P-8) 1,1,2,2-tetrakis(4-N,N-dimethylamino-2-methylphenyl)ethane,
(P-9) 1,1,5,5-tetrakis(4-N,N-dimethylamino-2-methylphenyl)pentane,
(P-10) 1,1-bis(4-N,N-diethylaminophenyl)heptane,
(P-11) 1,1-bis(4-N,N-diethylaminophenyl)-1-phenylmethane,
(P-12) 1,1-bis(4-N,N-diethylaminophenyl)-1-(2-thienyl)methane,
(P-13) 1,1-bis(4-N,N-diethylaminophenyl)-1-N-piperidylmethane,
(P-14) 3,3-diphenylallydidene-4,4'-bis(N,N-diethyl-m-toluidine),
(P-15) 1,1-bis(4-N,N-diethylamino-2-methylphenyl)-heptane,
(P-16) 1,1-bis(4-N,N-diethylamino-2-methylphenyl)-1-phenylmethane,
(P-17) 1,1-bis(4-N,N-diethylamino-2-methylphenyl)-3-phenylpropane,
(P-18) $\alpha,\alpha,\alpha',\alpha'$-tetrakis(4-N,N-diethylamino-2-methylphenyl)p-xylene,
(P-19) 1,1-bis(4-N,N-diethylamino-2-ethylphenyl)-4-methylcyclohexane,
(P-20) 1,1-bis(4-N,N-diethylamino-2-ethylphenyl)-2-phenylethane,
(P-21) 1,1-bis(4-N,N-diethylamino-2,5-dimethylphenyl)-heptane,
(P-22) 1,1-bis(4-N,N-diethylamino-2,5-dimethoxyphenyl)-1-phenylmethane
(P-23) 1,1-bis(4-N-ethyl-N-methylamino-2-methylphenyl)-3-methylcyclohexane
(P-24) 1,1-bis[4-N,N-di(p-tolyl)aminophenyl]cyclohexane
(P-25) 1,1-bis[4-N,N-di(p-tolyl)amino-2-methylphenyl]-cyclohexane
(P-26) 1,1-bis(4-N-ethyl-N-benzylaminophenyl)-1-cyclohexylmethane
(P-27) 1,1-bis(4-methyl-N-benzylamino-2-methylphenyl)normalbutane
(P-28) 1,1-bis(4-N-ethyl-N-benzylamino-2-methoxyphenyl)normalbutane
(P-29) 1,1-bis(4-N-ethyl-N-benzylamino-2-methoxyphenyl)-1-cyclohexylmethane
(P-30) 1,1-bis(4-N,N-dibenzylaminophenyl)propane
(P-31) 1,1-bis(4-N,N-dibenzylaminophenyl)normalbutane
(P-32) 1,1-bis(4-N,N-dibenzylaminophenyl)pentane
(P-33) 1,1-bis(4-N,N-dibenzylaminophenyl)-2-methylpropane
(P-34) 1,1-bis(4-N,N-dibenzylaminophenyl)cyclohexane
(P-35) 1,1-bis(4-N,N-dibenzylaminophenyl)-1-cyclohexylmethane
(P-36) 1,1-bis(4-N,N-dibenzylaminophenyl)-1-phenylmethane
(P-37) 1,1-bis(4-N,N-dibenzylamino-2-methylphenyl)-propane
(P-38) 1,1-bis(4-N,N-dibenzylamino-2-methylphenyl)-normalbutane
(P-39) 1,1-bis(4-N,N-dibenzylamino-2-methylphenyl)-pentane
(P-40) 1,1-bis(4-N,N-dibenzylamino-2-methylphenyl)-cyclohexane
(P-41) 1,1-bis(4-N,N-dibenzylamino-2-methylphenyl)-1-cyclohexylmethane
(P-42) 1,1-bis(4-N,N-dibenzylamino-2-methylphenyl)-1-phenylmethane
(P-43) 1,1-bis(4-N,N-dibenzylamino-2-methylphenyl)-1-(2-furyl)methane
(P-44) 1,1-bis(4-N,N-dibenzylamino-2-methylphenyl)-1-(4-pyridyl)methane
(P-45) 1,1-bis(4-N,N-dibenzylamino-2-methoxyphenyl)-propane
(P-46) 1,1-bis(4-N,N-dibenzylamino-2-methoxyphenyl)-normalbutane
(P-47) 1,1-bis(4-N,N-dibenzylamino-2-methoxyphenyl)-2-methylpropane
(P-48) 1,1-bis(4-N,N-dibenzylamino-2-methoxyphenyl)-1-cyclohexylmethane
(P-49) 1,1-bis(4-N,N-dibenzylamino-2,5-dimethylphenyl)normalbutane
(P-50) 1,1-bis(4-N,N-dibenzylamino-2,5-dimethylphenyl)-1-cyclohexylmethane
(P-51) 1,1-bis(4-N,N-dibenzylamino-2,5-dimethoxyphenyl)normalbutane
(P-52) 1,1-bis(4-N-morpholinophenyl)-1-(2-furyl)methane
(P-53) 1,1-bis(4-N-piperadinylphenyl)-1-(2-furyl)methane Typical examples of oxadiazole derivatives shown by said general formula [Q] are as follows.

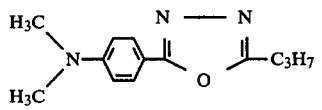
(Q-1)

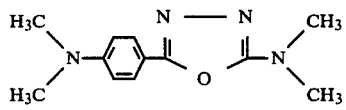
(Q-2)

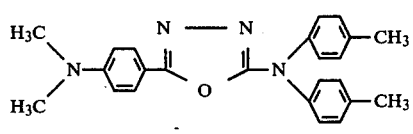
(Q-3)

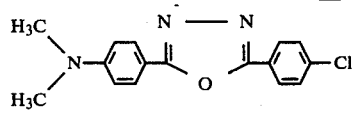
(Q-4)

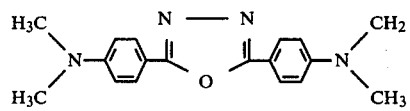
(Q-5)

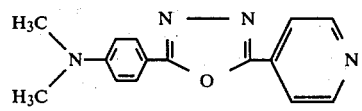
(Q-6)

-continued
(Q-7)
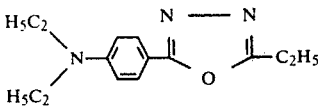
(Q-8)
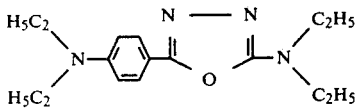
(Q-9)
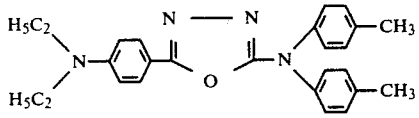
(Q-10)
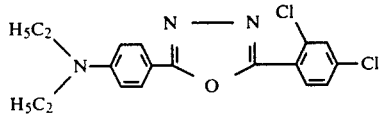
(Q-11)
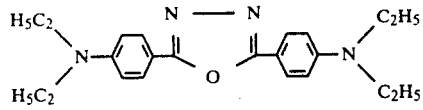
-continued
(Q-12)
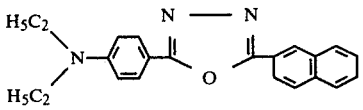
(Q-13)
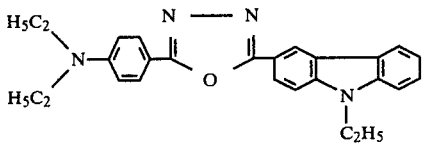
(Q-14)
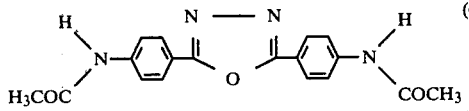
(Q-15)
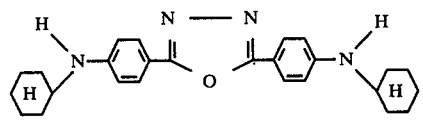
Further, typical examples of pyrazoline derivatives shown by said general formula [R] are as follows.
(R-1)
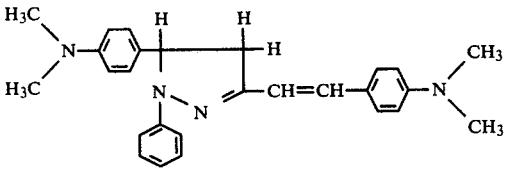
(R-2)
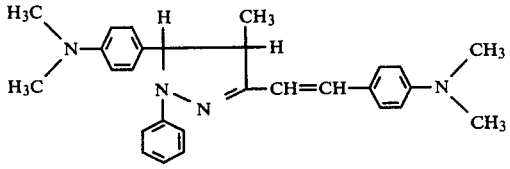
(R-3)
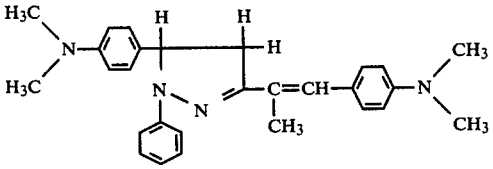
(R-4)
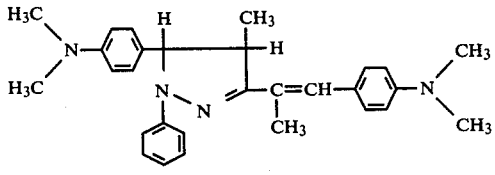
(R-5)
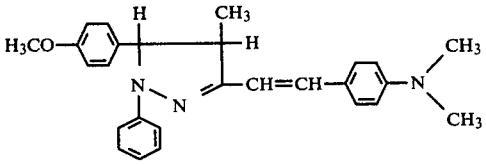
(R-6)
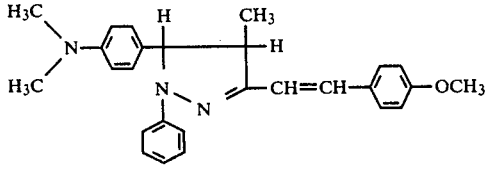

-continued
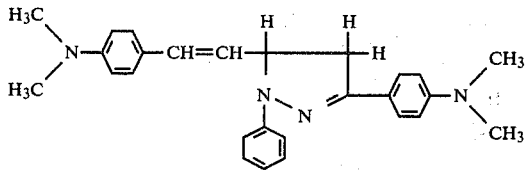
(R-7)
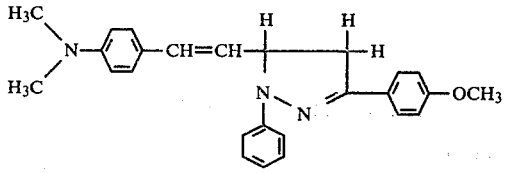
(R-8)
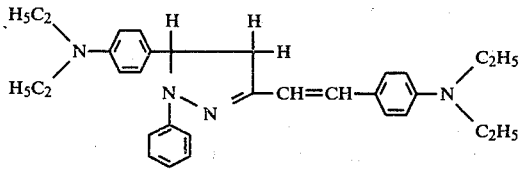
(R-9)
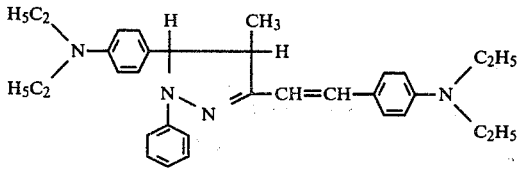
(R-10)
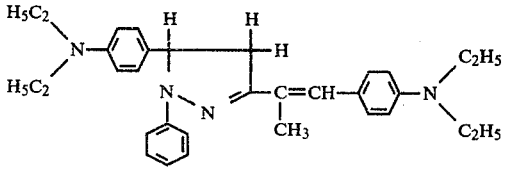
(R-11)
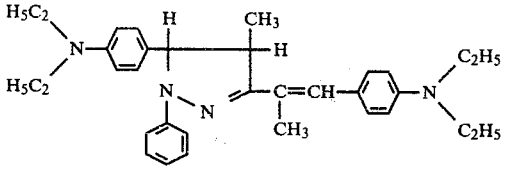
(R-12)
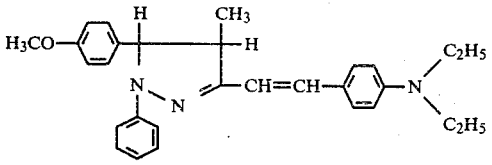
(R-13)
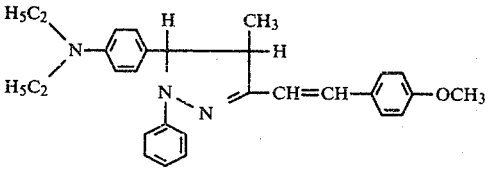
(R-14)
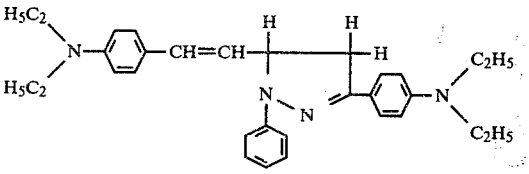
(R-15)

-continued
(R-16)
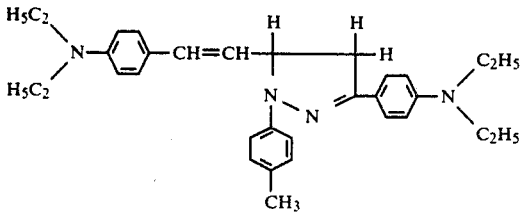
(R-17)
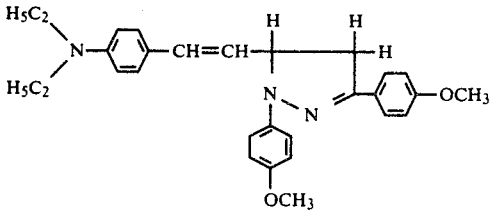
(R-18)
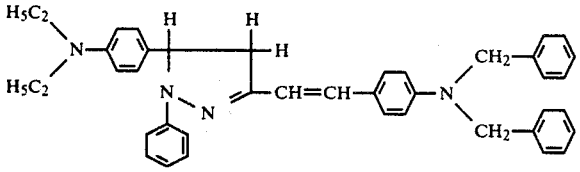
(R-19)
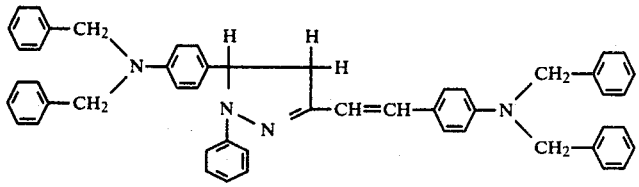
(R-20)
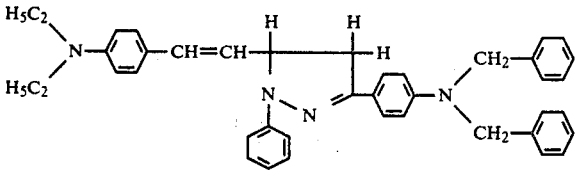
(R-21)
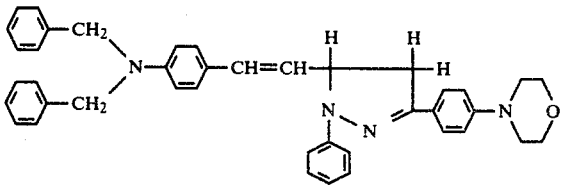
(R-22)
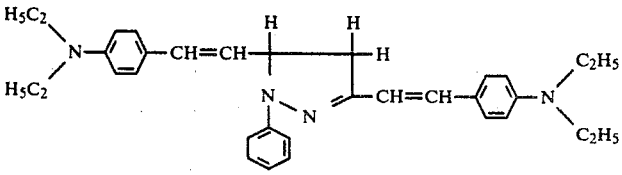
(R-23)
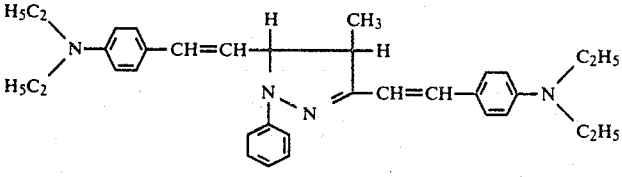

-continued

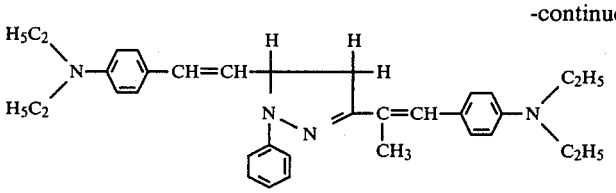

(R-24)

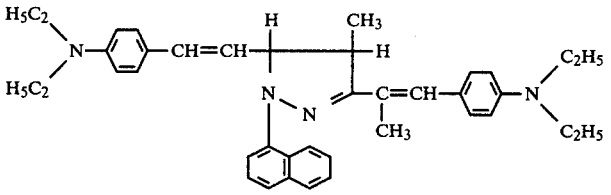

(R-25)

As is clear from examples and comparison examples mentioned later, in the photosensitive element of this invention having aforesaid construction, less electrical fatigue is brought about and less increase of accumulative remaining potential is observed on the photosensitive layer even after continuous electrophotographic process. Therefore, the photosensitive element of the invention has a long life without disadvantageous restriction for continuous copying and copied image of excellent quality without fog on the background can be obtained.

Further the photosensitive layer used for the photosensitive element of this invention has good stability against ultraviolet rays and change in the characteristics such as receptive potential, sensitivity and remaining potential, etc. in the light is extremely small with the lapse of time. Further, spontaneous deterioration owing to its long use is little and, therefore, maintenance and handling thereof can be made easy and simple. Further the carrier transport layer of the present invention can contain binder resin at a relatively high concentration without damaging its good characteristic and, accordingly, the mechanical strength of the photosensitive layer can be improved with the result that excellent resistance against mechanical damage such as resistance against developing and resistance against cleaning, etc. can be obtained.

The greatest advantage of this invention resides in the stable electrophotographic image-forming performance in the continuous use by the use of the carrier transport layer 3 mentioned above. And this effect, when a P-type semiconductor is selected from the compounds represented by the formula [P], is remarkable if at least one of $R_1$ and $R_2$ in the formula and at least one of $R_3$ and $R_4$ are aralkyl group and at least one of $R_7$ and $R_8$ and at least one of $R_9$ and $R_{10}$ are a compound containing electron donor-type substituent having $-I$ effect (negative induction effect) or $-M$ effect (negative mesomery effect), that is, halogen atom, hydroxyl group, or substituted or non-substituted alkyl group, cycloalkyl group, alkenyl group, cycloalkenyl group, aryl group, alkoxy group, aryloxy group or amino group. Further, when benzyl group is used, said effect is especially remarkable.

Although the reasons why the photosensitive element of this invention has excellent characteristics have not been made clear, the mechanism on its function can generally be considered in accordance with the mechanism of generation of persistent conductive effect described on the 7970th page of "Journal of the American Chemical Society, volume 94 (1972)" by Mr. William and other people. Namely, it is considered that in the usual photosensitive element for electrophotography of this type, the interface between carrier generation phase and carrier transport phase exists and carrier transport phase having no photoconductivity itself exists and many carrier traps exist in such interface and carrier transport phase, and to such carrier traps, positively charged carriers are trapped and remaining potential appears.

In this invention, however, it is considered that carriers are generated independently in the carrier transport phase by the action of the light in accordance with the mechanism given hereinafter, and thereby electric charge to be trapped is moved or countervailed and thereby it is possible to always keep the remaining potential at the fairly low value by neutralizing operation and its cumulative increase can be prevented:

A part of Brønsted acid HB, as is shown in formula (1), dissociates into proton $H^+$ and conjugate base $B^-$;

$$HB \rightleftarrows H^+ + B^- \quad (1)$$

wherein HB represent Bronsted acid.

Semiconductor represented by D of P-type that is an electron donor, on the other hand, forms a charge-transfer complex together with Lewis acid represented by A that is an electron acceptor as shown in formula (2).

$$D + A \rightleftarrows DA \quad (2)$$

This charge-transfer complex DA is excited to the single excited status as is shown in formula (3) on absorption of light.

$$DA \xrightarrow{h\nu} DA^* \quad (3)$$

This charge-transfer complex DA* in the excited status reacts with proton $H^+$ created in formula (1) and carrier with positive charge $D^{+\cdot}$ is created as shown in formula (4) and at the same time anion radical to which proton is added is created.

$$DA^* + H^+ \rightarrow HA\cdot + D^{+\cdot} \quad (4)$$

It is considered that the persistent conductive effect is considered to be generated in carrier transport phase by positive charge corrier $D^{+\cdot}$.

In above-mentioned mechanism, it is considered that although poly-N-vinylcarbazole or its derivatives does not appear to have any connection but taking the fact that the effect of this invention can not sufficiently be obtained with the carrier transport phase that does not contain such compound into consideration said compound may function to promote reactions (2), (3) and (4) because said compound is of electron donor type.

Further, poly-N-vinylcarbazole or its derivatives, as is generally known, has a second order molecular structure which is well-ordered and consequently it is naturally presumed that a third order molecular structure that affects the mobility of carrier may exist. Thus it is generally considered that such substance, even by itself, has a fairly large mobility against charge carriers of both polarity, and this is presumed to be the reason why polyvinylcarbazole or its derivatives are the essential ingredients for the carrier transport phase of this invention.

In this invention, the carrier transport phase can be used together with any known carrier generating phase and the construction of the photosensitive element can freely be selected. For example, as is shown in FIG. 3, the photosensitive element may be so constructed that an appropriate interlayer 5 is arranged on the conductive support 1 and through this, the carrier generating layer 2 is formed and thereupon, the carrier transport layer 3 is formed. It is possible to make this interlayer 5 possess the function to prevent free carrier to be injected from the conductive support to the photosensitive layer 4 when the photosensitive layer 4 is electrically charged and also the function as a adhesion layer that sticks the photosensitive layer 4 to the conductive support. As a material of such an interlayer 5, it is possible to use a metallic oxide such as aluminum oxide and indium oxide and a high polymer such as polyethylene, polypropylene, acrylic resin, methacrylic resin, vinyl chloride resin, vinyl acetate resin, epoxy resin, polyurethane, phenol resin, polyester resin, alkyd resin, polycarbonate, vinyl chloride-vinyl acetate copolymer, vinyl chloride-vinyl acetate-maleic anhydride copolymer.

Further as is shown in FIG. 4, it is feasible to compose the photosensitive layer 4 by forming a carrier generating layer 2 on the carrier transport layer 3 formed on the conductive support 1, if necessary with an interlayer.

Further as is shown in FIG. 5, it is feasible to compose the photosensitive layer 4 by dispersing the carrier generating phase 21 that is composed of carrier generating type substance in the stratiform carrier transport phase 31. In this case, it is preferred to disperse in an amount of 0.1–100 parts by weight, preferably 1–50 parts by weight of carrier generating type substance per 100 parts by weight of the material that forms the carrier transport phase 31. When the ratio of carrier generating type substance is too small, the sensitivity as a photosensitive element is low and when it is too great, the strength of the photosensitive layer 4 becomes small.

As stated above, it is possible to adopt various types of mechanical composition in this invention and as for such mechanical composition and design of carrier generating layer having an excellent mobility for the carrier with certain polarity and furthermore charging of the photosensitive layer 4 in electrophotographic process on certain polarity, persons skilled in the art may select the preferable one.

Examples of this invention will be illustrated as follows but the scope of this invention will not be limited by such examples.

EXAMPLE 1

On a conductive support obtained by vacuum depositing aluminum on a 100$\mu$ thick polyethyleneterephthalate substrate, an interlayer with the thickness of about 0.1$\mu$ composed of vinyl chloride-vinyl acetate maleic anhydride copolymer "S-lec MF-10" (made by SEKISUI CHEMICAL CO., LTD.) was arranged and 4,10-dibromoanthranthrone (Monolite Red 2Y C.I. No. 59300) that is a polycyclic quinone pigment was vacuum deposited on said interlayer in an atmosphere of a vacuum of $2\text{-}3\times10^{-4}$ Torr. at an evaporation source temperature of 350° C. for 3 minutes thereby forming a carrier-generating layer with a thickness of about 0.5 microns.

Meanwhile, 6 g of aromatic amino-compound shown on (P-41), 5 g of poly-N-vinylcarbazole "Luvican M170" (made by BASF A.G.), 0.05 g of 2,4,7-trinitro-9-fluorenon, 0.2 g of 3,5-dinitrobenzoic acid and 3.5 g of polycarbonate resin "Panlite L-1250" (made by Teijin Kadei K.K.) were dissolved in the mixed solvent composed of 40 ml of 1,2-dichloroethane and 50 ml of monochlorobenzene and a solution thereby obtained was coated onto said carrier generating layer with the use of a doctor blade and by drying at 80° C. for 1 hour, a carrier transport layer with a thickness of 15 microns was formed and a photosensitive element for electrophotography of this invention (sample No. 1) was prepared.

EXAMPLE 2

A carrier generating layer with a thickness of about 0.5 microns and a carrier transport layer with a thickness of 15 microns were formed and a photosensitive element for electrophotography of this invention (sample No. 2) was prepared in the same manner as the example 1 with an exception that N,N'-dimethyl-perylene-3,4,9,10-tetracarboxylic acid diimido (Paliogen Maroon 3920 C.I. No. 71130) that is a perylene pigment was used instead of a polycyclic quinone pigment in the example 1.

EXAMPLE 3

A carrier generating layer with a thickness of about 0.1 microns and a carrier transport layer with a thickness of 14 microns were formed and a photosensitive element for electrophotography of this invention (sample No. 3) was prepared in the same manner as the example 1 with an exception that 4,4',7,7'-tetrachlorothioindigo that is a indigoid pigment (Cromophtal Bordeaux RN C.I. No. 73312) was used instead of a hypolic quinone pigment in the example 1.

EXAMPLE 4

To the solution where 4 g of polycarbonate resin was dissolved in 100 ml of 1,2-dichloroethane, 4 g of 4,10-dibromoanthanthrone that is a hypolic quinone pigment was added and a supersonic dispersion was made thereon and dispersion liquid obtained therefrom was coated onto the interlayer arranged in the same manner as the example 1 on a conductive support that is the same as the example 1 and a carrier generating layer with a thickness of 2 microns was formed.

Meanwhile, 6 g of aromatic amino-compound shown on (P-28), 5 g of poly-N-vinylcarbazole, 0.1 g of bromanyl, 0.4 g of picric acid and 3.5 g of polycarbonate resin were dissolved in 90 ml of tetrahydrofuran and a solution obtained therefrom was coated onto said carrier generating layer with the use of a doctor blade and after drying thereof at 80° C. for 1 hour, a carrier transport layer with a thickness of 16 microns was formed and thereby a photosensitive element for electrophotography of this invention (sample No. 4) was prepared.

EXAMPLE 5

A carrier generating layer with a thickness of 1 micron and a carrier transport layer with a thickness of 15 microns were formed and a photosensitive element for electrophotography of this invention (sample No. 5) was prepared in the same manner as the example 1 with an exception that selenium was used instead of a hypolic quinone pigment in the example 1.

EXAMPLE 6–8

Using ones shown on (P-16), (P-29) and (P-35) respectively instead of aromatic amino-compound shown on (P-41) in an example 1, three photosensitive elements for electrophotography of this invention (sample No. 6, No. 7 and No. 8) having carrier transport layers of 14 microns, 14 microns and 15 microns respectively were prepared in the same manner as the example 1.

EXAMPLE 9

In a mixed solvent composed of 40 ml of 1,2-dichloroethane and 50 ml of monochlorobenzene, 6 g of aromatic aminocompound shown on (P-41), 5 g of poly-N-vinylcarbazole, 0.05 g of 2,4,7-trinitro-9-fluorenon, 0.2 g of 3,5-dinitro benzoic acid and 3.5 g of polycarbonate resin were dissolved and to the solution obtained hereby, 1.5 g of 4,10-dibromoanthanthrone was added and a supersonic dispersion was made thereupon and this dispersion liquid was coated onto the conductive support having the interlayer obtained in the same manner as the example 1 and after drying thereof, the photosensitive layer of the type shown in FIG. 5 with a thickness of 13 microns was formed and thus photosensitive element for electrophotography of this invention (sample No. 9) was prepared.

EXAMPLE 10 and 11

Using oxadiazole derivative shown on (Q-11) and pyrazoline derivative shown on (R-9) were used respectively instead of aromatic aminocompound (P-41) in example 1, two photosensitive elements for electrophotography of this invention (sample No. 10 and No. 11) having respectively a transport layer with a thickness of 15 microns each were prepared in the same manner as the example 1.

COMPARISON EXAMPLE 1

A photosensitive element for electrophotography (comparison sample No. 1) having a carrier transport layer with a thickness of 14 microns was prepared in the same manner as the example 1 with an exception that 10 g of poly-N-vinylcarbazole and 1.5 g of polycarbonate resin were dissolved in the mixed solvent composed of 10 ml of 1,2-dichloroethane and 100 ml of monochlorobenzene and the solution thus obtained was used for the formation of the carrier transport layer. The carrier transport layer of this comparison sample No. 1 is the one that does not contain P-type semiconductor, Lewis acid and Bronsted acid.

COMPARISON EXAMPLE 2

A photosensitve element for electrophotography (comparison sample No. 2) having a carrier transport layer with a thickness of 14 microns and containing no Lewis acid and no Brønsted acid was prepared in the same manner as the example 1 with an exception that 2,4,7-trinitro-9-fluorenon and 3,5-dinitro benzoic acid were excluded in the preparation of solution for the formation of the carrier transport layer in the example 1.

COMPARISON EXAMPLE 3

A photosensitive element for electrophotography (comparison sample No. 3) having a carrier transport layer with a thickness of 15 microns and containing no Lewis acid was prepared in the same manner as the example 1 with an exception that 2,4,7-trinitro-9-fluorenon was excluded in the preparation of solution for the formation of the carrier transport layer in the example 1.

COMPARISON EXAMPLE 4

A photosensitive element for electrophotography (comparison sample No. 4) having a carrier transport layer with a thickness of 15 microns and containing no Brønsted acid was prepared in the same manner as the example 1 with an exception that 3,5-dinitro benzoic acid was excluded in the preparation of solution for the formation of the carrier transport layer in the example 1.

COMPARISON EXAMPLE 5

A photosensitive element for electrophotography (comparison sample No. 5) having a carrier transport layer with a thickenss of 14 microns was prepared in the same manner as the example 1 with an exception that 8 g of polycarbonate resin was used and poly-N-vinylcarbazole was excluded in the preparation of solution for the formation of the carrier transport layer in the example 1.

COMPARISON EXAMPLE 6

A photosensitive element for electrophotography (comparison sample No. 6) having a carrier transport layer with a thickness of 16 microns and containing no poly-N-vinylcarbazole, no Lewis acid and no BRonsted acid was prepared in the same manner as the example 1 with an exception that 6 g of aromatic amino-compound shown on (P-41) and 8 g of polycarbonate resin were dissolved in 53 ml of 1,2-dichloroethane and a solution thus obtained was used as a solution for the formation of the carrier transport layer.

Samples No. 1–No. 11 and comparison samples No. 1–No. 6 obtained in the aforesaid examples and comparison examples were set on the electrometer model SP-428 (made by Kawaguchi Denki Seisakusho K.K.) and charging operation was done for 5 seconds with an impressed voltage of −6 KV for discharging electrode of the charging device, and the charged voltage Vo (V) on the surface of the photosensitive layer and irradiated light amount E1/2 (1x. sec) needed to reduce such charged voltage Vo to a half both immediately after said charging operation were measured. The results thereof are shown in Table 1.

TABLE 1

| Photosensitive element for electrophotography | | Vo (V) | $E_{\frac{1}{2}}$ (lx . sec) | Thickness of CTL (μ) |
|---|---|---|---|---|
| Sample No. (Present invention) | No. 1 | −780 | 1.9 | 15 |
| | No. 2 | −915 | 4.5 | 15 |
| | No. 3 | −940 | 6.3 | 14 |
| | No. 4 | −935 | 3.8 | 16 |
| | No. 5 | −1250 | 7.6 | 15 |
| | No. 6 | −890 | 3.6 | 14 |
| | No. 7 | −860 | 1.8 | 14 |
| | No. 8 | −910 | 2.1 | 15 |
| | No. 9 | −775 | 8.8 | 13 |
| | No. 10 | −1130 | 6.2 | 15 |
| | No. 11 | −1035 | 5.6 | 15 |
| Comparative Sample No. | No. 1 | −1260 | 12.0 | 14 |
| | No. 2 | −1175 | 1.9 | 14 |
| | No. 3 | −1120 | 1.9 | 15 |
| | No. 4 | −960 | 2.0 | 15 |
| | No. 5 | −885 | 1.9 | 14 |
| | No. 6 | −800 | 1.5 | 16 |

Note:
"CTL" stands for carrier transport layer.

Further, said samples No. 1–No. 11 and comparison samples No. 1–No. 6 were set on the dry type electrophotographic copying machine U-BiX 2000R (made by Konishiroku Photo Ind. Co., Ltd.) for continuous copying and the potential on the image background on the photosensitive layer at the exposure stop value 2.5 was measured by an electrostatic-volt-meter type 144D-1D (made by Monroe Electronics Inc.). The results are shown in Table 2.

TABLE 2

| Photosensitive element for electrophotography | | Potential on image background (V) | | |
|---|---|---|---|---|
| | | Beginning | After 5000 copies | Increase amount |
| Sample No. (Present invention) | No. 1 | −90 | −90 | 0 |
| | No. 2 | −165 | −170 | 5 |
| | No. 3 | −240 | −245 | 5 |
| | No. 4 | −120 | −140 | 20 |
| | No. 5 | −255 | −260 | 5 |
| | No. 6 | −115 | −170 | 55 |
| | No. 7 | −85 | −85 | 0 |
| | No. 8 | −90 | −120 | 30 |
| | No. 9 | −290 | −295 | 5 |
| | No. 10 | −235 | −245 | 10 |
| | No. 11 | −205 | −205 | 0 |
| Comparative Sample No. | No. 1 | −480 | −595 | 115 |
| | No. 2 | −90 | −400 | 310 |
| | No. 3 | −105 | −225 | 120 |
| | No. 4 | −95 | −295 | 200 |
| | No. 5 | −90 | −405 | 315 |
| | No. 6 | −80 | −430 | 350 |

Figure 1:
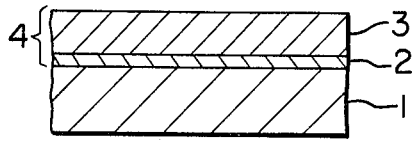
FIG. 1 is an enlarged sectional view for illustration that shows an example of the composition of the photosensitive element for electrophotography of this invention.
Figure 2:
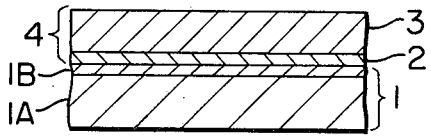
FIG. 2 is an enlarged sectional view for illustration showing a variation example of an electric conductive support.
Figure 3:
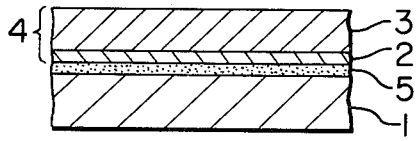
FIG. 3 and FIG. 4 are an enlarged sectional view for illustration showing another composition of this invention and FIG. 5 is an enlarged sectional view for illustration showing another composition of the photosensitive layer.
Figure 4:
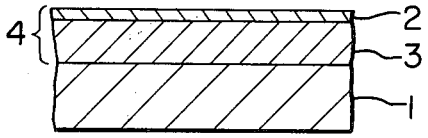
Figure 5:
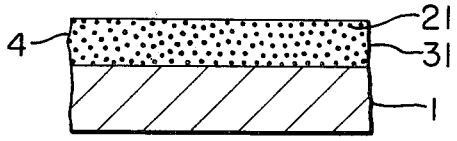

1 ... Electric conductive support
2 ... Carrier generating layer
3 ... Carrier transport layer 4 ... Photosensitive layer
5 ... Interlayer 21 ... Carrier generating phase -continued 31 ... Carrier transport phase

What is claimed is:

1. A photosensitive element for electrophotography comprising on an electrically conductive support a carrier generating phase and a carrier transport phase containing a P-type organic semiconductor, a poly-N-vinylcarbazole and/or its derivative, a Lewis acid which is not a proton donor, and a Bronsted acid.

2. A photosensitive element according to claim 1, wherein said P-type organic semiconductor is a compound selected from the group consisting of polyarylalkane-type aromatic amino compounds represented by the formula [P];

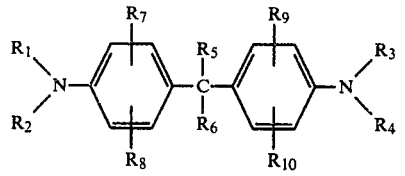

[P]

wherein, $R_1$, $R_2$, $R_3$ and $R_4$ independently represent a hydrogen atom, substituted or unsubstituted alkyl group, cycloalkyl group, alkenyl group, cycloalkenyl group, or aryl group; $R_5$ and $R_6$ independently represent hydrogen atom, substituted or unsubstituted alkyl group, cycloalkyl group, alkenyl group, cycloalkenyl group, aryl group, or heterocyclic group; and, $R_7$, $R_8$, $R_9$ and $R_{10}$ independently represent hydrogen atom, halogen atom, acyl group, hydroxyl group, substituted or unsubstituted alkyl group, cycloalkyl group, alkenyl group, cycloalkenyl group, aryl group, alkoxy group, aryloxy group or amino group; and $R_1$ and $R_2$, and/or $R_3$ and $R_4$ may jointly form cyclohydrocarbon group or heterocyclic group, oxazole derivatives represented by the formula [Q];

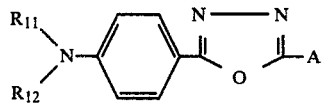

[Q]

wherein, $R_{11}$ and $R_{12}$ independently represent the same atom or group as $R_1$ and $R_2$ above and A represents substituted or unsubstituted alkyl group, amino group, aryl group or heterocyclic group and pyrazoline derivatives represented by the formula [R];

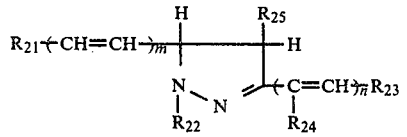

[R]

wherein, $R_{21}$, $R_{22}$ and $R_{23}$ independently represent substituted or unsubstituted aryl group, $R_{24}$ and $R_{25}$ independently represent hydrogen atom, substituted or unsubstituted alkyl group or aryl group, and m and n independently represent 0 or 1.

3. A photosensitive element according to claim 1, wherein said Lewis acid is a π-electron acceptor or a σ-electron acceptor.

4. A photosensitive element according to claim 3, wherein said Lewis acid is one selected from the group consisting of 2,7-dinitrofluorenone, 2,4,7-trinitrofluorenone, 2,4,5,7-tetranitrofluorenone, tetracyanoethylene, tetracyanoquinodimethane, chloranyl, bromanyl, dichlorodicyano parabenzoquinone, anthraquinone, dinitroanthraquinone, quinonechlorimide, paranitrobenzonitrile, picrylchloride, o-dinitrobenzene, m-dinitrobenzene, 1,3,5-trinitrobenzene, maleic anhydride, dibromomaleic anhydride, succinic anhydride, phthalic anhydride, tetrachlorophthalic anhydride, tetrabromophthalic anhydride, 3-nitrophthalic anhydride, 4-nitrophthalic anhydride, mellitic anhydride, pyromellitic anhydride.

5. A photosensitive element according to claim 3, wherein said Lewis acid is one selected from the group consisting of 2,4,7-trinitrofluorenone, 2,4,5,7-tetranitrofluorenone, chloranyl, bromanyl, tetrachlorophthalic anhydride, and tetrabromophthalic anhydride.

6. A photosensitive element according to claim 1, wherein said Brønsted acid is one selected from the group consisting of trichloroacetic acid, tribromoacetic acid, β-chloropropionic acid, stearic acid, behenic acid, maleic acid, fumaric acid, crotonic acid, benzoic acid, o-nitrobenzoic acid, p-nitrobenzoic acid, 2,4-dinitrobenzoic acid, 3,5-dinitrobenzoic acid, pentafluorobenzoic acid, 2,4-dichlorobenzoic acid, salicylic acid, 5-nitrosalicylic acid, 3,5-dinitrosalicylic acid, p-chloro-m-cresol, picric acid, phthalic acid, terephthalic acid, mellitic acid, DL-mandelic acid, cinnamic acid.

7. A photosensitive element according to claim 1, wherein said Brønsted acid is 3,5-dinitrobenzoic acid or picric acid.

8. A photosensitive element according to claim 1, wherein said poly-N-vinylcarbazole or its derivative has the average molecular weight ranging from 100,000 to 1,000,000.

* * * * *